US006107015A

United States Patent [19]

Anderson et al.

[11] Patent Number: 6,107,015

[45] Date of Patent: Aug. 22, 2000

[54] PHOTOGRAPHIC ELEMENT HAVING A STAIN RESISTANT ELECTRICALLY CONDUCTIVE OVERCOAT

[75] Inventors: Charles C. Anderson, Penfield; Brian A. Schell, Honeoye Falls; Mario D. DeLaura, Hamlin, all of N.Y.

[73] Assignee: Eastman Kodak Company, Rochester, N.Y.

[21] Appl. No.: 09/274,644

[22] Filed: Mar. 23, 1999

[51] Int. Cl.[7] ..... G03C 1/89; G03C 1/77

[52] U.S. Cl. ..... 430/525; 430/527; 430/530; 430/531; 430/535; 430/529

[58] Field of Search ..... 430/527, 528, 430/529, 530, 531, 535, 525, 536

[56] References Cited

U.S. PATENT DOCUMENTS

| | | | |
|---|---|---|---|
| Re. 34,348 | 8/1993 | Heilmann et al. | 526/245 |
| 3,574,791 | 4/1971 | Sherman et al. . | |
| 3,728,151 | 4/1973 | Sherman et al. . | |
| 3,753,716 | 8/1973 | Ishihara et al. | 430/529 |
| 4,229,524 | 10/1980 | Yoneyama et al. | 430/536 |
| 4,579,924 | 4/1986 | Schwartz et al. | 526/243 |
| 5,350,795 | 9/1994 | Smith et al. | 524/507 |
| 5,607,663 | 3/1997 | Rozzi et al. | 424/49 |
| 5,662,887 | 9/1997 | Rozzi et al. | 424/49 |
| 5,718,995 | 2/1998 | Eichorst et al. | 430/531 |
| 5,786,134 | 7/1998 | Nair et al. | 430/527 |
| 5,962,207 | 10/1999 | Anderson et al. | 430/527 |

*Primary Examiner*—Richard L. Schilling
*Attorney, Agent, or Firm*—Carl F. Ruoff; Doreen M. Wells

[57] ABSTRACT

The present invention is a photographic element having a support, at least one silver halide emulsion layer superposed on a first side of the support and a protective overcoat superposed on a second said of the support. The protective overcoat includes a polyurethane having a tensile elongation to break of at least 50% and a Young's modulus measured at 2% elongation of at least 50,000 lb/in$^2$, an interpolymer composed of repeating units of A and B wherein A comprises a fluorine containing acrylate or a fluorine containing methacrylate monomer and B comprises an ethylenically unsaturated monomer containing hydratable groups and an electrically conductive agent.

10 Claims, No Drawings

PHOTOGRAPHIC ELEMENT HAVING A STAIN RESISTANT ELECTRICALLY CONDUCTIVE OVERCOAT

CROSS REFERENCE TO RELATED APPLICATIONS

This application relates to commonly assigned copending application Ser. No. 09/273,644 filed simultaneously herewith and hereby incorporated by reference for all that it discloses.

FIELD OF THE INVENTION

The present invention relates to an improved photographic element, and more particularly to a photographic element that resists tar adsorption and stain absorption and has antistatic properties.

BACKGROUND OF THE INVENTION

In the photographic industry the need to protect an imaging element from dirt and dust, scratches and abrasion, and deposition of stains has long been recognized. Many studies have been focused on the prevention of dirt and dust attraction through the use of antistatic layers in imaging elements. Recent improvements in protective overcoats have reduced the propensity for imaging elements to be scratched or abraded during manufacture and use. Far less attention has been given to improving the stain resistance of imaging elements.

The treatment of articles such as textiles and food containers with soil and stain resistant compositions is well known. For example, U.S. Pat. Nos. 3,574,791 and 3,728,151 disclose block or graft copolymers which have two different segments, one of which is highly fluorinated and oleophobic and the other of which is hydrophilic. U.S. Pat. No. 4,579,924 describes fluorochemical copolymers useful as paper making additives which impart oil and water repellancy and food stain resistance to ovenable paperboard food containers. U.S. Pat. No. 5,350,795 describes aqueous and oil repellent compositions which cure at ambient temperature. The compositions comprise an aqueous solution or dispersion of a fluorochemical acrylate copolymer and a polyalkoxylated polyurethane having pendant perfluoroalkyl groups. U.S. Pat. No. Re. 34,348 discloses stain resistant compositions containing fluorinated polymers derived from acrylamide-functional monomers. Fluorocarbon containing coatings for hard tissue and surfaces of the oral environment that reduce staining and adhesion of bacteria and proteinaceous substances are described in U.S. Pat. Nos. 5,662,887 and 5,607,663.

U.S. Pat. No. 4,229,524 describes copolymers containing perfluoroalkyl groups which can be used in a layer of a photosensitive material to improve antistatic and adhesion properties of the layer.

For a photographic element the requirements for a stain resistant overcoat are rather unique. The stain resistant layer must not effect the transparency, color, or other imaging properties of the film. The application and curing of the stain resistant coating must be compatible with the photographic element manufacturing process. The overcoat layer must be able to provide stain resistance when applied as a submicron-thick layer. In addition, the stain resistant overcoat should have excellent physical properties including resistance to scratch, abrasion, ferrotyping and blocking.

A wide variety of substances may adsorb onto or absorb into either the front or back surface of photographic elements and cause a permanent stain that degrades image quality. The deposition of these stain causing substances onto a photographic element may occur in many different ways. For example, dirt, fingerprints, and grease may be deposited onto the photographic element during handling. A photographic element may be stained when it comes in contact with a dirty surface or as a result of an accidental spill from, for example, a liquid drink such as coffee or soda. Other stains may be deposited onto a wet photographic element during film processing. For example, a tar-like material which is derived mostly from polymeric oxidized developer and which may be present at the surface of or on the walls of film processing solution tanks may be deposited during film processing. This tar may adhere to or diffuse into the surface layer of the photographic element and cause an extremely difficult to remove, brown-colored stain.

Film processor tar deposits and stain have been a particular problem with some protective overcoats used on motion picture film. In U.S. Pat. No. 5,786,134 and copending commonly-assigned, now U.S. Pat. Nos. 5,962,207 and 5,952,165 are described improved motion picture films that resist tar pickup. In these patent applications, the backside of the films contain a stain resistant layer applied over the protective overcoat. The protective overcoat is, in turn, applied over an electrically conductive layer. The present invention relates to eliminating tar pickup during processing and various problems associated with the generation of static charge by providing a new protective overcoat. This protective overcoat is obtained by the coating and subsequent drying of a coating composition containing a polyurethane, an interpolymer containing at least two different segments; one of which is fluorinated and therefore oleophobic, the other of which is hydratable, and an electrically conductive agent. Thus, in the present invention, stains such as tar deposits and problems associated with the generation of static charge are eliminated without the need to coat the two additional layers of the prior art. Further, the protective overcoat of the invention does not degrade the transparency, frictional characteristics, or other physical properties of the photographic element, and may be applied from solvent or aqueous media at low cost.

SUMMARY OF THE INVENTION

The present invention is a photographic element having a support, at least one silver halide emulsion layer superposed on a first side of the support and a protective overcoat superposed on a second said of the support. The protective overcoat includes a polyurethane having a tensile elongation to break of at least 50% and a Young's modulus measured at 2% elongation of at least 50,000 lb/in$^2$, an interpolymer composed of repeating units of A and B wherein A comprises a fluorine containing acrylate or a fluorine containing methacrylate monomer and B comprises an ethylenically unsaturated monomer containing hydratable groups and an electrically conductive agent.

DETAILED DESCRIPTION OF THE INVENTION

In accordance with the present invention there is provided a photographic element containing a polymeric support having on one side thereof, at least one silver halide emulsion layer and on the opposite side thereof, as the outermost layer, a stain resistant and electrically conductive protective overcoat; characterized in that the stain resistant and electrically conductive protective overcoat includes a polyurethane, a stain resistant interpolymer, and an electrically conductive agent. Preferably, the polyurethane has a tensile elongation to break of at least 50% and a Young's modulus measured at a 2% elongation of at least 50000 lb/in$^2$. The stain resistant interpolymer has repeating units of A and B wherein A is a fluorine containing acrylate or methacrylate monomer and B is an ethylenically unsaturated monomer containing hydratable groups. The electrically conductive agent is inherently stable toward photographic processing solutions.

The photographic support materials used in the practice of the invention can comprise any of a wide variety of supports. Typical supports include cellulose nitrate film, cellulose acetate film, poly(vinyl acetal) film, polystyrene film, poly (ethylene terephthalate) film, poly(ethylene naphthalate) film, polycarbonate film, glass, metal, paper, polymer-coated paper, and the like. The thickness of the support is not critical. Support thickness of 2 to 10 mils (0.002–0.010 inches) can be employed, for example, with very satisfactory results. To promote adhesion, an undercoat or primer layer is typically employed on polyester support. Such undercoat layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088, 2,698,235, 2,698,240, 2,943,937, 3,143,421, 3,201,249, 3,271,178 and 3,501,301.

The use of film-forming hydrophilic colloids as binders in photographic elements, including photographic films and photographic papers, is very well known. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar—agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to one or more emulsion layers, the elements of the present invention can contain auxiliary layers conventional in photographic elements, such as overcoat layers, antihalation layers, spacer layers, filter layers, interlayers, pH lowering layers (sometimes referred to as acid layers and neutralizing layers), timing layers, opaque reflecting layers, opaque light-absorbing layers and the like.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure,* Item 36544, September, 1994, and the references listed therein.

The photographic silver halide emulsions utilized in this invention can contain other addenda conventional in the photographic art. Useful addenda are described, for example, in *Research Disclosure,* Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The protective overcoat of the present invention contains a polyurethane, a stain resistant interpolymer, and an electrically conductive agent. Preferably, the polyurethane is an aliphatic polyurethane. Aliphatic polyurethanes are preferred due to their excellent thermal and UV stability and freedom from yellowing. Preferably, the polyurethanes of the present invention are characterized as those having a tensile elongation to break of at least 50% and a Young's modulus measured at an elongation of 2% of at least 50,000 lb/in$^2$. These physical property requirements help insure that the overcoat layer is hard yet tough to simultaneously provide excellent abrasion resistance and outstanding resiliency.

The polyurethane may be either organic solvent soluble or aqueous dispersible. For environmental reasons, aqueous dispersible polyurethanes are preferred. Preparation of aqueous polyurethane dispersions is well-known in the art and involves chain extending an aqueous dispersion of a prepolymer containing terminal isocyanate groups by reaction with a diamine or diol. The prepolymer is prepared by reacting a polyester, polyether, polycarbonate, or polyacrylate having terminal hydroxyl groups with excess polyfunctional isocyanate. This product is then treated with a compound that has functional groups that are reactive with an isocyanate, for example, hydroxyl groups, and a group that is capable of forming an anion, typically this is a carboxylic acid group. The anionic groups are then neutralized with a tertiary amine to form the aqueous prepolymer dispersion.

The stain resistant interpolymer of the invention is a vinylic interpolymer having repeat units of A and B where A is derived from fluorine-containing acrylate or methacrylate monomers and B is derived from ethylenically unsaturated monomers containing hydratable groups.

More specifically, the unit A is derived from a fluoro (meth)acrylate or mixture of fluoro(meth)acrylates represented by the following formula:

$$(R_f)_pLOCOCR{=}CH_2$$

where the $R_f$ substituent is a monovalent, fluorinated, aliphatic organic radical having at least one carbon atom and as many as 20 carbon atoms, preferably, 2 to 10 carbon atoms. The skeletal chain of $R_f$ can be straight, branched, or cyclic, and can include catenary divalent oxygen atoms or trivalent nitrogen atoms bonded only to carbon atoms. Preferably, $R_f$ is fully fluorinated, but carbon-bonded hydrogen or chlorine atoms can be present as substituents on the skeletal chain of $R_f$. Preferably, $R_f$ contains at least a terminal perfluoromethyl group. Preferably, p is 1 or 2.

The linking group L is a bond or hydrocarbyl radical linkage group containing from 1 to 12 carbon atoms and optionally substituted with and/or interrupted with a substituted or unsubstituted heteratom such as O, P, S, N. R is either H or methyl. Preferably, the fluoro(meth)acrylate monomer contains at least 30 weight percent fluorine.

Non-limiting examples of fluoro(meth)acrylates useful in the present invention include:

$$CF_3(CF_2)_x(CH_2)_yOCOCR{=}CH_2$$

where x is 0 to 20, preferably 2 to 10, y is 1 to 10, and R is H or methyl $$HCF_2(CF_2)_x(CH_2)_yOCOCR{=}CH_2$$

here x is 0 to 20, preferably 2 to 10, y is 1 to 10, and R is H or methyl

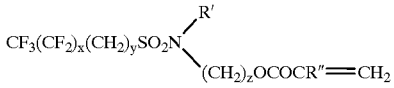

where x is 0 to 20, preferably 2 to 10, y is 1 to 10, z is 1 to 4, R' is alkyl or arylalkyl, and R" is H or methyl

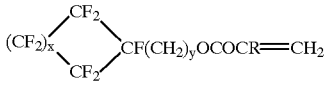

where x is 0 to 7, y is 1 to 10, and R is H or methyl $$CF_3(CF_2CF_2O)_x(CF_2O)_y(CH_2)_zOCOCR{=}CH_2$$

where x+y is at least 1 up to 20, z is 1 to 10, and R is H or methyl.

The B unit is derived from ethylenically unsaturated monomers containing hydratable, ionic or hydratable, nonionic groups or combinations of hydratable ionic and hydratable, nonionic groups. Monomers containing hydratable, ionic groups include mono- or multifunctional carboxyl containing monomers represented by the following formula:

$$CH_2{=}CRL(COOH)_x$$

where R is H, methyl, ethyl, carboxy, carboxymethyl, or cyano, L is a bond or hydrocarbyl radical linkage group containing from 1 to 12 carbon atoms and optionally substituted with and/or interrupted with a substituted or unsubstituted heteratom such as O, P, S, N. X is equal to 1 or 2. This unit may be present in its protonated acid form or salt form after neutralization with an organic or inorganic base.

The B unit may also be derived from ethylenically unsaturated monomers containing sulfonic acid groups, such as vinyl sulfonic acid, styrene sulfonic acid, 2-acrylamido-2-methyl propane sulfonic acid, and the like. Alternatively, the B unit may be derived from ethylenically unsaturated monomers containing phosphorous acid or boron acid groups. These units may be present in their protonated acid form or salt form.

The B unit may be derived from substituted or unsubstituted ammonium monomers such as N,N,N-trialkylammonium methyl styrene, N,N,N-trialkylammonium akyl (meth)acrylate, N,N,N-trialkylammonium (meth)acrylamide, etc., where the counterion may be fluoride, chloride, bromide, acetate, propionate, laurate, palmate, stearate, etc.

The B unit may further be derived from ethylenically unsaturated monomers containing nonionic, hydrophilic groups. Suitable monomers include: mono- or multifunctional hydroxyl containing monomers such as hydroxyalkyl (meth)acrylates and N-hydroxyalkl (meth)acrylamides; poly (oxyalkylene)-containing (meth)acrylates and poly (oxyalkylene)-containing itaconates, (meth)acrylamide, and vinyl pyrrolidone.

Preferably, the monomer containing nonionic, hydrophilic groups is a (meth)acrylate containing a poly(oxyalkylene) group in which the oxyalkylene unit has 2 to 4 carbon atoms, such as —$OCH_2CH_2$—, —$OCH_2CH_2CH_2$—, —$OCH(CH_3)CH_2$—, or —$OCH(CH_3)CH(CH_3)$—. The oxyalkylene units in said poly(oxyalkylene) being the same, as in poly (oxypropylene), or present as a mixture, as in a heteric straight or branched chain of blocks of oxyethylene units and blocks of oxypropylene units. The poly(oxyalkylene) group contains 4 to about 200, preferably, 15 to about 150 oxyalkylene units. A representative example of a poly (oxyalkylene)-containing meth(acrylate) suitable for the purpose of the present invention is represented by the following formula:

$$CH_2{=}CR'COO(CH_2CH_2O)_xR''$$

where R' and R" are independently H or methyl, x is 4 to 200.

The fluoro(meth)acrylate interpolymers of the invention comprise 10 to 90 weight % of units A and 10 to 90 weight % of units B. Minor, non-interfering amounts of monomers other than those described above can also be incorporated into the fluoro(meth)acrylate interpolymers of this invention. For example, the interpolymers of this invention can contain up to about 40 weight percent, and preferably up to about 30 weight per cent, of polymer units derived from ethylene, vinyl acetate, vinyl halide, vinylidene halide, acrylonitrile, alkyl (meth)acrylates, methacrylonitrile, glycidyl acrylate, glycidyl methacrylate, styrene, alkyl styrenes, vinylpyridine, vinyl alkyl ethers, vinyl alkyl ketones, butadiene, vinyl silanes, and mixtures thereof.

The fluoro(meth)acrylate interpolymers of the invention may be random, graft, or block copolymers. The molecular weight of the interpolymers may be from about 5000 to about 10,000,000. Preferably, to promote surface activity of the stain resistant fluoropolymer, the molecular weight of the interpolymer should be from about 5000 to 100,000 and most preferably, from about 5000 to about 50,000. The interpolymers may be organic solvent soluble, but preferably, they are water soluble or water dispersible.

The protective overcoat of the invention contains an electrically conductive agent that is inherently stable toward photographic processing solutions, i.e., the conductive properties of the electrically conductive agent are not destroyed as a result of film processing. The protective overcoat has a resistivity before and after film processing which is about $5\times10^{11}$ Ω/□ or less. The preferred electrically conductive agents for use in the protective overcoat are;

1) electrically conductive metal-containing particles including donor-doped metal oxides, metal oxides containing oxygen deficiencies, and conductive nitrides, carbides, and bromides. Specific examples of particularly useful particles include conductive $SnO_2$, $In_2O_3$, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103; 4,394,441; 4,416,963; 4,418,141; 4,431,764; 4,495,276; 4,571,361; 4,999,276; 5,122,445 and 5,368,995.
2) fibrous electrically conductive powders comprising, for example, antimony-doped tin oxide coated onto non-conductive potassium titanate whiskers as described in U.S. Pat. Nos. 4,845,369 and 5,166,666 and antimony-doped tin oxide fibers or whiskers as described in U.S. Pat. Nos. 5,719,016 and 5,0731,119.
3) the electrically conductive polyacetylenes, polythiophenes, and polypyrroles of U.S. Pat. Nos. 4,237,194; 5,370,981, and Japanese Patent Applications 2282245 and 2282248.

For the purpose of the present invention, specific examples of particularly preferred electrically conductive agents include, antimony-doped tin oxide acicular particles or "whiskers" such as FS-10D from Ishihara Sangyo Kaisha Ltd. or electrically conducting polythiophene such as the commercially available thiophene-containing polymer supplied by Bayer Corporation as Baytron P. These conductive agents are unaffected by film processing solutions and provide excellent antistatic properties even when used in very low concentrations.

The protective overcoats of the invention contain from about 2 to about 20 volume per cent of the electrically conductive agent. Volume per cent is used since the density of the electrically conductivity agents can vary widely, for example, from a density of a little more than 1 g/cm$^3$ for electrically conductive polymers to a density of nearly 7 g/cm$^3$ for electrically conductive metal oxides. The protective overcoat contains, on a weight basis, a ratio of polyurethane to fluoro(meth)acrylate interpolymer of from about 6 to about 0.5, and preferably from about 4 to about 1, and most preferably from about 4 to about 2. Surprisingly, we have found that within these concentration ranges for the electrically conductive agent, the polyurethane, and the stain resistant interpolymer the requirements for good antistatic properties, physical properties, and stain resistance can be achieved simultaneously.

The abrasion resistance of the protective overcoats of the invention can be improved by adding a crosslinking agent that reacts with functional groups present in the polyurethane and/or the interpolymer, for example, carboxyl groups. Crosslinking agents such as aziridines, carbodiimides, epoxies, and the like are suitable for this purpose. The crosslinking agent can be used at about 0.5 to about 30 weight percent based on the total dry weight of the protective overcoat. However, a crosslinking agent concentration of about 2 to 12 weight percent based on the dry coating weight is preferred.

The stain resistant protective overcoat is preferably coated from a coating formula containing from about 0.5 to about 20.0 weight percent solids to give a dry coating weight of from about 50 to about 3000 mg/m$^2$.

A suitable lubricating agent can be included to give the stain resistant protective overcoat a coefficient of friction that ensures good transport characteristics during manufacturing and customer handling of the photographic film. Many lubricating agents can be used, including higher alcohol esters of fatty acids, higher fatty acid calcium salts, metal stearates, silicone compounds, paraffins and the like as described in U.S. Pat. Nos. 2,588,756; 3,121,060; 3,295,979; 3,042,522 and 3,489,567. For satisfactory transport characteristics, the lubricated surface should have a coefficient of friction of from 0.10 to 0.40. However, the most preferred range is 0.15 to 0.30. If the protective overcoat coefficient of friction is below 0.15, there is a significant danger that long, slit rolls of the photographic film will become unstable in storage or shipping and become telescoped or dished, a condition common to unstable film rolls. If the coefficient of friction is above 0.30 at manufacture or becomes greater than 0.30 after photographic film processing, a common condition of non-process surviving protective overcoat lubricants, the photographic film transport characteristics become poorer, particularly in some types of photographic film printers and projectors.

Aqueous dispersed lubricants are strongly preferred since lubricants, in this form, can be incorporated directly into an aqueous protective overcoat formula, thus avoiding a separately applied lubricant layer on the protective overcoat layer. The aqueous dispersed lubricants of carnauba wax, polyethylene oxide, microcrystalline wax, paraffin wax, silicones, stearates and amides work well as incorporated lubricants in the aqueous, protective overcoat. However, the aqueous dispersed lubricants of carnauba wax and stearates are preferred for their effectiveness in controlling friction at low lubricant levels and their excellent compatibility with aqueous binders.

In addition to lubricants, matting agents are important for improving the transport of the film on manufacturing, printing, processing, and projecting equipment. Also, these matting agents can reduce the potential for the protective overcoat to ferrotype when in contact with the emulsion side surface under the pressures that are typical of roll films. The term "ferrotyping" is used to describe the condition in which the backside outermost layer, when in contact with the emulsion side under pressure, as in a tightly wound roll, adheres to the emulsion side sufficiently strongly that some sticking is noticed between the backside layer and the emulsion side surface layer when they are separated. In severe cases of ferrotyping, damage to the emulsion side surface may occur when the protective topcoat and emulsion side surface layer are separated. This severe damage may have an adverse sensitometric effect on the emulsion.

The stain resistant protective overcoat of the present invention may contain matte particles. The matting agent may be silica, calcium carbonate, or other mineral oxides, glass spheres, ground polymers and high melting point waxes, and polymeric matte beads. Polymeric matte beads are preferred because of uniformity of shape and uniformity of size distribution. The matte particles should have a mean diameter size of about 0.5 to about 5 micrometers. However, preferably the matte particles have a mean diameter of from about 0.75 to about 2.5 micrometers. The matte particles can be employed at a dry coating weight of about 1 to about 100 mg/m$^2$. The preferred coating weight of the matte particles is about 1 to about 50 mg/m$^2$.

The present invention will now be described in detail with reference to specific examples, however, the present invention should not be limited to these examples.

Preparation of stain resistant interpolymer

The following monomers were used in the preparation of the stain resistant interpolymer.

FX-13 2-(N-ethylperfluorooctanesulfonamido)ethyl acrylate

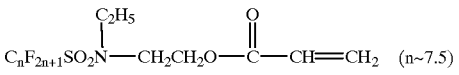

PGMA poly(ethylene glycol) methacrylate

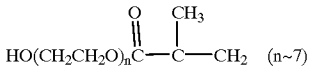

AA acrylic acid

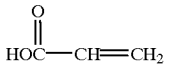

The interpolymer was prepared via free radical solution polymerization in tetrahydrofuran solvent, then neutralized with triethylamine and dispersed in deionized water. An example preparation for an interpolymer containing a fluoro acrylate (3M Fluorad™ FX-13), polyethyleneglycol methacrylate (Carbowax-550 acrylate, PGMA), and acrylic acid (AA) is given below.

Fluorad™ FX-13 (56 g), PGMA (16 g), and AA (8 g) were charged into a 1 liter round-bottom flask, along with 320 g of tetrahydrofuran and 0.5 g of AIBN initiator. The flask was swirled briefly to dissolve the monomer-initiator mixture, which was then sparged with nitrogen for 10 minutes. The flask was sealed with a rubber septum and immersed in a constant temperature water bath at 60° C. for 24 hours. The resultant polymer solution was then cooled to room temperature, neutralized by addition of 11 g of triethylamine, and finally diluted with deionized water to yield an aqueous polymer solution containing 7.7% solids. This polymer contained a weight ratio of FX-13/PGMA/AA equal to 60/30/10 and had a molecular weight of 16,000.

EXAMPLE 1

A subbed polyester support was prepared by first applying a subbing terpolymer of acrylonitrile, vinylidene chloride and acrylic acid to both sides of the support before drafting and tentering so that the final coating weight was about 90 mg/m$^2$.

A protective overcoat of the invention consisting of the following components was prepared, the layer was applied over the terpolymer subbing layer on one side of the support at a dry coating weight of 1 g/m$^2$.

| | |
|---|---|
| stain resistant interpolymer, FX-13/PGMA/AA = 60/30/10 | 200 mg/m$^2$ |
| Sancure 898* aqueous dispersed polyurethane (B. F. Goodrich Corp.) | 600 mg/m$^2$ |
| polyfunctional aziridine crosslinking agent (CX100, Zeneca Resins Co.) | 30 mg/m$^2$ |
| antiomony-doped tin oxide whiskers (FS-10D, Ishihara Sangyo Kaisha Ltd.) | 5 vol % |

*Sancure 898 has tensile elongation to break equal to 210% and a Young's modulus measured at an elongation of 2% equal to 115,000 lb/in$^2$ This sample was then tested for electrical resistivity and processor tar stain resistance.

Tar Stain Test

During routine film development, by-products of oxidized color developer will form brown, oily residue that may be adsorbed by the film surface and may create permanent, brown stained spots, i.e. tar.

A simulated developer tar test was performed on the samples to determine their propensity for tar /stain build-up. The test was done at 105° F. and involved smearing tar harvested from a developer tank onto the coating immersed in a developer bath followed by removal of the tar using dilute sulfuric acid. The resultant stain or tar is indicative of the propensity of the coating for tar adsorption.

Electrical Resistivity Test

The surface electrical resistivity was measured with a Kiethley Model 616 digital electrometer using a two point DC probe by a method similar to that described in U.S. Pat. No. 2,801,191. The resistivity was measured on the stain resistant protective overcoat side of the film.

Example 1 gave a resistivity value of $5\times10^9$ Ω/□ before and after film processing, which is indicative of a highly conductive layer that should provide excellent antistatic performance. Example 1 also provided excellent resistance to processor tar stain.

Other protective overcoat compositions of the invention were prepared and evaluated for tar stain resistance and electrical resistivity. The description of the coating compositions and the results obtained are given in the following table. The interpolymer used in the following examples had a weight ratio of FX-13/PGMA/AA equal to 60/30/10. The protective overcoats were applied at a total dry coating weight of 1 g/m$^2$ and contained 30 mg/M$^2$ of CX100 polyfunctional aziridine crosslinking agent.

As can be seen in the following results, only protective overcoat compositions of the invention provide excellent resistance to processor tar stain while giving resistivity values less than $5\times10^{11}$ Ω/□ which is indicative of effective antistatic properties. Overcoats that contain a high ratio of polyurethane to fluoro(meth)acrylate interpolymer (Comparative Samples C1–C3) provide poor resistance to tar stain.

| Coating | Volume % of FS-10D | Weight ratio of Sancure 898 polyurethane/interpolymer | Surface resistivity Ω/□ | Tar stain resistance |
|---|---|---|---|---|
| Example 2 | 3 | 3.25 | $2 \times 10^{11}$ | good |
| Comparative Sample C1 | 4 | 15 | $2.5 \times 10^9$ | poor |
| Comparative Sample C2 | 4 | 7 | $2 \times 10^9$ | poor |
| Example 3 | 4 | 4.3 | $2.5 \times 10^9$ | fair |
| Example 4 | 6 | 2.75 | $1 \times 10^9$ | excellent |

-continued

| Coating | Volume % of FS-10D | Weight ratio of Sancure 898 polyurethane/interpolymer | Surface resistivity Ω/□ | Tar stain resistance |
|---|---|---|---|---|
| Comparative Sample C3 | 7 | 13 | $1.5 \times 10^8$ | poor |
| Example 5 | 7 | 6.0 | $1.5 \times 10^8$ | fair |
| Example 6 | 7 | 3.7 | $3 \times 10^8$ | good |
| Example 7 | 7 | 2.5 | $5 \times 10^8$ | good |
| Example 8 | 9 | 2.25 | $2.5 \times 10^8$ | excellent |
| Example 9 | 10 | 2 | $8 \times 10^7$ | excellent |
| Example 10 | 12 | 1.5 | $5 \times 10^7$ | excellent |
| Example 11 | 20 | 1.0 | $2.5 \times 10^7$ | excellent |

The invention has been described in detail with particular reference to certain preferred embodiments thereof, but it will be understood that variations and modifications can be effected within the spirit and scope of the invention.

What is claimed is:

1. A photographic element comprising:

a support;

at least one silver halide emulsion layer superposed on a first side of said support;

a protective overcoat superposed on a second side of said support, said protective overcoat comprising a polyurethane having a tensile elongation to break of at least 50% and a Young's modulus measured at 2% elongation of at least 50,000 lb/in$^2$, an interpolymer comprising repeating units of A and B wherein A comprises a fluorine containing acrylate or a fluorine containing methacrylate monomer and B comprises an ethylenically unsaturated monomer containing hydratable groups and an electrically conductive agent and the ratio of polyurethane to interpolymer is ≦6:1.

2. The photographic element of claim 1 wherein the support comprises cellulose nitrate film, cellulose acetate film, poly(vinyl acetal) film, polystyrene film, poly(ethylene terephthalate) film, poly(ethylene naphthalate) film, polycarbonate film, glass, metal or paper.

3. The photographic element of claim 1 wherein the repeating unit A is derived from a fluoro(meth)acrylate represented by the following formula:

$$(R_f)_pLOCOCR{=}CH_2$$

where the $R_f$ substituent is a monovalent, fluorinated, aliphatic organic radical having at least one carbon atom and as many as 20 carbon atoms, p is 1 or 2 and L is a bond or hydrocarbyl radical linkage group containing from 1 to 12 carbon atoms and R is either H or methyl.

4. The photographic element of claim 3 wherein the fluoro(meth)acrylate monomer contains at least 30 weight percent fluorine.

5. The photographic element of claim 1 wherein the repeating unit B is derived from monomers represented by the following formula:

$$CH_2{=}CRL(COOH)_x$$

where R is H, methyl, ethyl, carboxy, carboxymethyl, or cyano, L is a bond or hydrocarbyl radical linkage group containing from 1 to 12 carbon atoms, X is equal to 1 or 2.

6. The photographic element of claim 1 wherein the interpolymer comprises from 10 to 90 weight % of units A and from 10 to 90 weight % of units B.

7. The photographic element of claim 1 wherein the interpolymer comprise a molecular weight of from about 5000 to about 10,000,000.

8. The photographic element of claim 1 wherein the electrically conductive agent comprises electrically conductive metal-containing particles, fibrous electrically conductive powders, electrically conductive polyacetylenes, electrically conductive polythiophenes or electrically conductive polypyrroles.

9. The photographic element of claim 1 wherein the electrically conductive agent comprises 2 to about 20 volume percent of the protective overcoat.

10. The photographic element of claim 1 wherein the protective overcoat further comprises crosslinking agents, lubricating agents or matting agents.

* * * * *